US007040065B2

(12) United States Patent
Pickup

(10) Patent No.: US 7,040,065 B2
(45) Date of Patent: May 9, 2006

(54) ORNAMENT AND BRACKET

(75) Inventor: Leslie William Pickup, 35 Buckle Street, Northgate, Queensland, 4013 (AU)

(73) Assignees: Leslie William Pickup, Queensland (AU); Kerry Anne Pickup, Queensland (AU)

( * ) Notice: Subject to any disclaimer, the term of this patent is extended or adjusted under 35 U.S.C. 154(b) by 80 days.

(21) Appl. No.: 10/480,007

(22) PCT Filed: May 31, 2002

(86) PCT No.: PCT/AU02/00697

§ 371 (c)(1),
(2), (4) Date: May 10, 2004

(87) PCT Pub. No.: WO02/099224

PCT Pub. Date: Dec. 12, 2002

(65) Prior Publication Data

US 2004/0172897 A1 Sep. 9, 2004

(30) Foreign Application Priority Data

Jun. 6, 2001 (AU) ..... PR5507

(51) Int. Cl.
*E04B 2/00* (2006.01)

(52) U.S. Cl. ..... 52/287.1; 52/288.1; 52/289; 52/716.1

(58) Field of Classification Search ..... 52/288.1, 52/287.1, 289, 716.1, 718.07, 718.04, 718.06; D25/136, 55, 138
See application file for complete search history.

(56) References Cited

U.S. PATENT DOCUMENTS 3,707,061 A * 12/1972 Collette et al. ..... 52/288.1
4,723,580 A * 2/1988 Trautwein ..... 138/163
5,359,817 A * 11/1994 Fulton ..... 52/288.1
5,398,469 A * 3/1995 Logan ..... 52/288.1
5,457,923 A 10/1995 Logan et al.
5,592,797 A * 1/1997 Logan et al. ..... 52/288.1
5,694,726 A * 12/1997 Wu ..... 52/287.1
5,732,747 A * 3/1998 Holliday ..... 138/163
6,643,990 B1 * 11/2003 Jensen ..... 52/716.1

FOREIGN PATENT DOCUMENTS

| | | |
|---|---|---|
| AU | 35041/58 | 2/1959 |
| AU | 60032/60 | 5/1961 |
| AU | 9410/66 | 8/1966 |
| AU | 638604 | 7/1993 |
| DE | 19723558 | 12/1998 |
| GB | 2287043 | 2/1994 |
| GB | 2 283 044 A | 4/1995 |
| GB | 2337777 | 11/1999 |

* cited by examiner

*Primary Examiner*—Carl D. Friedman
*Assistant Examiner*—Chi Q. Nguyen
(74) *Attorney, Agent, or Firm*—Tarolli, Sundheim, Covell & Tummino L.L.P.

(57) ABSTRACT

A removably mountable ornament assembly as a temporary or permanent fitting to a wall and/or ceiling is provided. The ornament may be a cornice or skirting board, and a bracket is provided for releasably engaging and mounting the cornice or skirting board to a wall and/or ceiling. The arms of the bracket each terminate in mating portions that releasably engage respective complementary channels in the cornice. The ornament assembly provides an alternative to traditional plaster cornices and may be mounted to cover an existing cornice or moulding.

9 Claims, 9 Drawing Sheets

ORNAMENT AND BRACKET

FIELD OF THE INVENTION

THIS INVENTION relates to a removable ornament for a wall and/or ceiling. In particular, this invention relates to a removable cornice and a bracket for mounting the cornice to a wall and/or ceiling that provides an alternative to traditional plaster cornices. More particularly, this invention provides a removable cornice and bracket that may be mounted to cover an existing cornice.

BACKGROUND OF THE INVENTION

Building panels such as walls and ceilings may be decorated with ornaments such as cornices, covings, picture rails, ceiling roses, skirting boards and timber mouldings that cover unsightly joints or otherwise provide decoration.

These types of ornaments are particularly common in older houses under restoration, or as reproductions that give a new house a traditional appearance.

Ornaments such as cornices are typically made of plaster, which makes them difficult to remove for the purposes of replacement, and difficult to install without the assistance of a tradesman or skilled home handyman.

This problem has been partly addressed in British Patent 2283044 where a cornice is provided that can be installed by way of a right-angle bracket mountable to a wall and/or ceiling, to which is fitted a cornice that fits snugly into flanged ends of the bracket arms. However, the cornice bracket of British Patent 2283044 has a number of deficiencies. Firstly, the cornice when mounted does not completely cover the bracket ends. Secondly, given that adhesive is used to facilitate firm mounting of the cornice to the bracket, the cornice is not readily removable from the bracket. This lack of reusability is compounded by a requirement that frangible locating flanges on the bracket arms must be permanently removed to perfect assembly. Also, this right-angle bracket requires that an existing cornice be removed before the cornice can be mounted.

In Australian Patent 638604, a renovating cornice is provided that is shaped to be superimposed over an existing cornice to thereby remove the need to remove the existing cornice. The renovating cornice is glued or otherwise tightly superimposed over the existing cornice.

OBJECT OF THE INVENTION

The present inventor has realized that prior art cornices cannot be readily removably mounted to a wall or ceiling and, where necessary, without removal of an existing cornice. Furthermore, the prior art has not provided a system whereby ornaments of different sizes, profiles and shapes can be mounted by a simple, re-usable all-purpose bracket that is readily installed by persons other than skilled tradesmen.

It is therefore an object of the invention to provide a cornice assembly removably mountable to a wall and/or ceiling.

SUMMARY OF THE INVENTION

In one aspect, the invention provides a bracket for removably mounting an ornament to a building panel, said bracket comprising at least one mating portion adapted to engage a complementary mating portion of said ornament.

Preferably, said bracket comprises a mounting arm and said mating portion.

In one embodiment, said mating portion is in the form of an open loop adapted to engage complementary mating portions of said ornament.

In another embodiment, said mating portion is in the form of a nub adapted to engage a complementary mating portion of said ornament.

In yet another embodiment, said mating portion is in the form of a step adapted to engage a complementary mating portion of said ornament.

In a particular embodiment, said bracket comprises a first mounting arm terminating in a first said mating portion and a second mounting arm terminating in a second said mating portion, said first and second mounting arms interconnected by an intermediate portion which in use, is extendible diagonally across an existing ornament mounted at a junction between first and second said building panels, such as at a junction between a wall and a ceiling.

In another aspect, the invention provides an ornament removably mountable to one or more building panels, said ornament having at least one complementary mating portion adapted to releasably engage a mating portion of a bracket for removably mounting said ornament to said building panel(s).

In a particular embodiment, said ornament has mating portions in the form of two parallel channels releasably engageable with respective mating portions of at least a first bracket and a second bracket.

In yet another aspect, the invention provides an ornament assembly removably mountable to a building panel, said assembly comprising one or more brackets according to the first-mentioned aspect and one or more ornaments according to the second-mentioned aspect.

The ornament assembly of the invention may be particularly useful as a kit comprising a plurality of said brackets and said one or more ornaments.

In a further aspect, the invention provides one or more building panel having the ornament assembly of the third-mentioned aspect removably mounted thereto.

In one embodiment, the building panels, such as a wall and ceiling, have an existing ornament mounted thereto.

According to this embodiment, said bracket is mountable to said building panels at a position relative to said existing cornice such that said ornament at least partly covers said existing ornament when mounted to said bracket.

In a still further aspect, the invention provides a method of removably mounting an ornament to one or more building panels including the steps of:

(i) removably mounting one or more brackets to said building panel(s); and (ii) releasably engaging complementary mating portions of said ornament with respective mating portions of said one or more brackets to thereby removably mount said ornament to said building panel(s).

In a particular embodiment, said ornament is mounted so as to at least partly cover an existing ornament mounted to said building panel.

As used herein, an ornament may be a cornice, coving, picture rails, ceiling rose, skirting board or timber moulding, although without limitation thereto.

Preferably, said ornament is a cornice or skirting board.

It will be appreciated from the foregoing that said ornament assembly may be removably mounted to one or more building panels such as a wall and/or ceiling to preferably decorate a junction or gap formed between said building panels. A particular, optional feature of the invention is that the ornament may be removably mounted to cover an existing ornament mounted to said building panels thereby obviating the need to remove said existing ornament.

Throughout this specification, unless otherwise indicated, "comprise", "comprises" and "comprising" are used inclusively rather than exclusively, so that a stated integer or group of integers may include one or more other non-stated integers or groups of integers.

DETAILED DESCRIPTION OF THE PREFERRED EMBODIMENT

Figure 1:
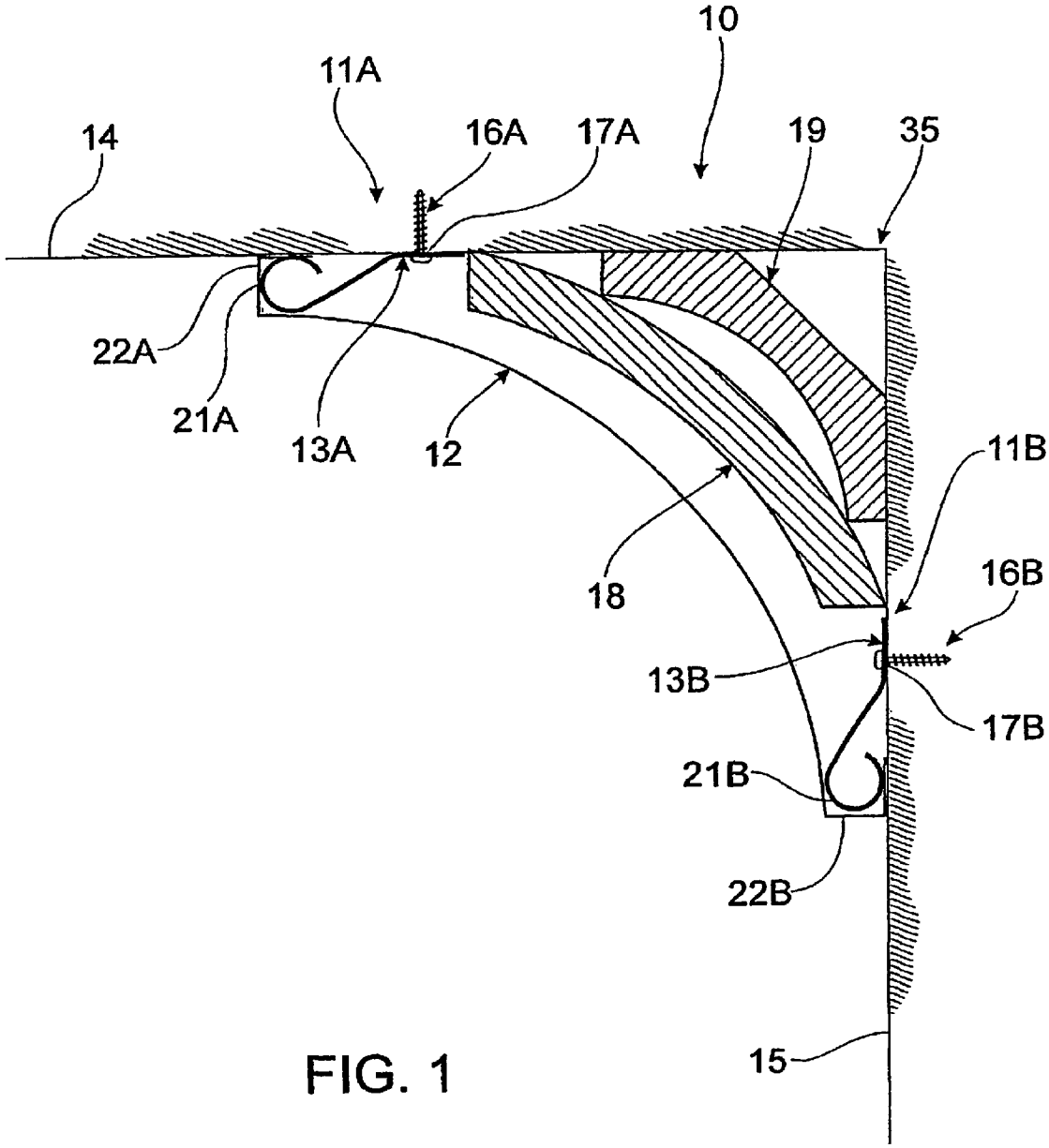
FIG. 1 Side view of a removable cornice and one embodiment of a bracket mounted to cover an existing cornice or timber moulding.

Referring to FIG. 1, removably mountable ornament assembly 10 comprises first bracket 11A, second bracket 11B and cornice 12. Bracket 11A has mounting arm 13A mountable to ceiling 14 while bracket 11B has mounting arm 13B mountable to wall 15 at or adjacent to junction 35 between wall 15 and ceiling 14. Mounting arms 13A and 13B are each mounted by way of respective screws 16A, 16B extending through respective apertures 17A, 17B. Although FIG. 1 shows a pair of brackets 11A and 11B, it will be appreciated that, typically, more than two brackets 11 may be removably mounted along wall 15 and ceiling 14 according to the length of cornice 12 in order to firmly secure cornice 12 while preventing sagging.

In the embodiment shown in FIG. 1, brackets 11A and 11B are positioned a sufficient distance relative to existing cornice 18 or timber moulding 19 to allow mounting of removable cornice 12 such that existing cornice 18 is substantially covered by removable cornice 12.

Brackets 11A and 11B respectively terminate in mating portions in the form of open loops 21A and 21B, distal to respective mounting arms 13A and 13B. Cornice 12 has complementary mating portions in the form of channels 22A and 22B that releasably engage open loops 21A and 21B. In this particular embodiment, loops 21A and 21B respectively engage channels 22A and 22B in a releasable, "male to female" mating relationship.

Removable cornice 12 may be made of metal, such as steel or tinplate, bent to shape to form channels 22A and 22B, although other materials such as aluminium and plastic could be used. A preferred material is steel. Preferred forms of plastic are high impact styrene or rigid PVC.

Suitable materials would also allow for the addition of surface patterning and ornamentation of removable cornice 12 while retaining channels 22A and 22B.

Figure 2:
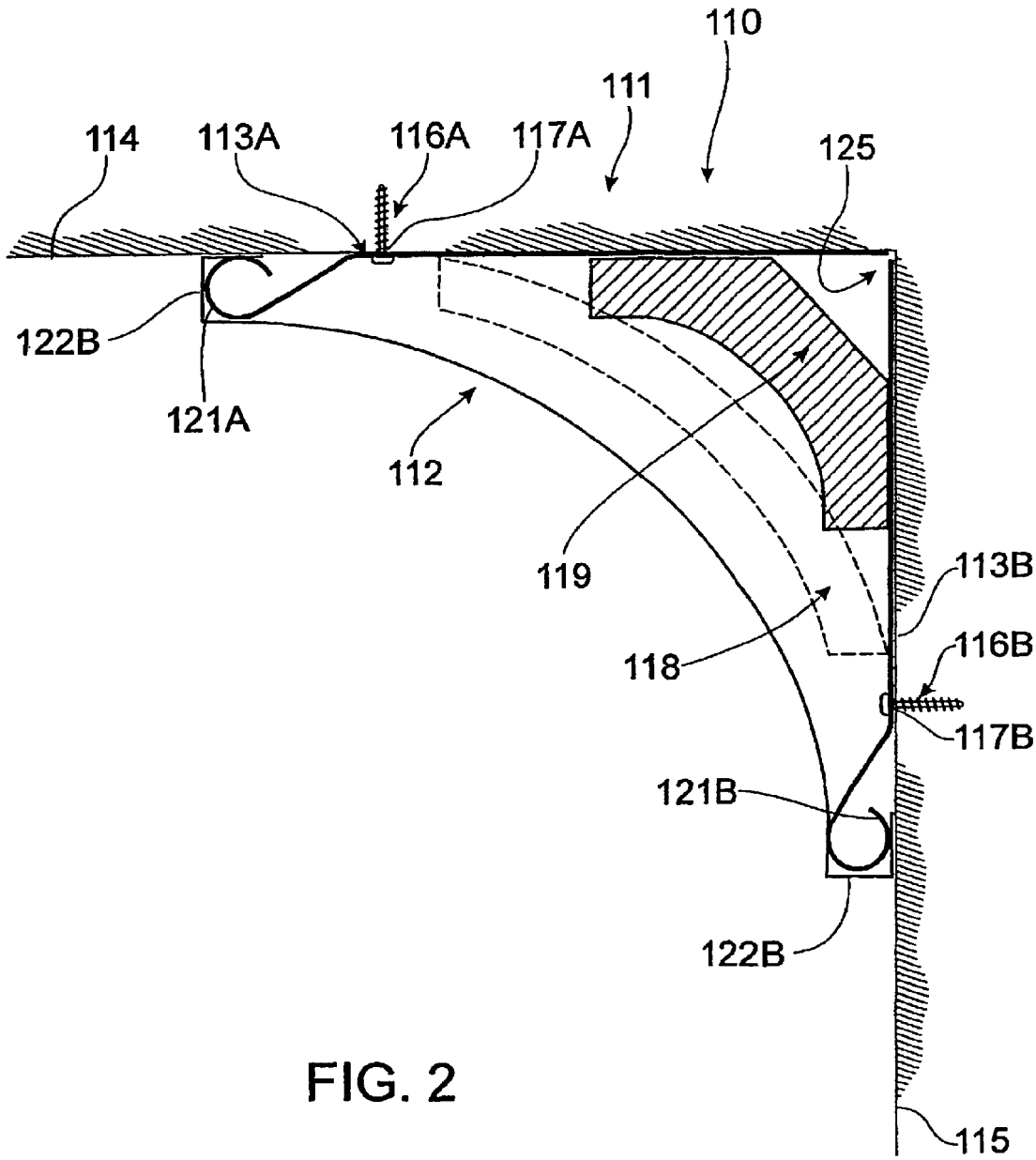
FIG. 2 Side view of a removable cornice and another embodiment of the bracket mounted to cover an existing cornice or timber moulding.

Referring now to FIG. 2, there is shown another embodiment of ornament assembly 110 where brackets 111A and 111B that are of extended length relative to that shown in FIG. 1. In this embodiment, mounting arms 113A and 113B are adapted to be inserted behind existing cornice 118 or timber moulding 119, thereby forming join 125, to allow mounting of removable cornice 112. Mounting arms 113A and 113B are preferably about 0.8–1.0 mm thick, or more preferably 0.9 mm thick, to enable insertion behind existing cornice 118 or timber moulding 119. This may be assisted by inserting a blade at a desired location between existing cornice 118 or timber moulding 119 and wall 115 and/or ceiling 114 to thereby form a space into which arms 113A and 113B may be inserted.

Figure 3:
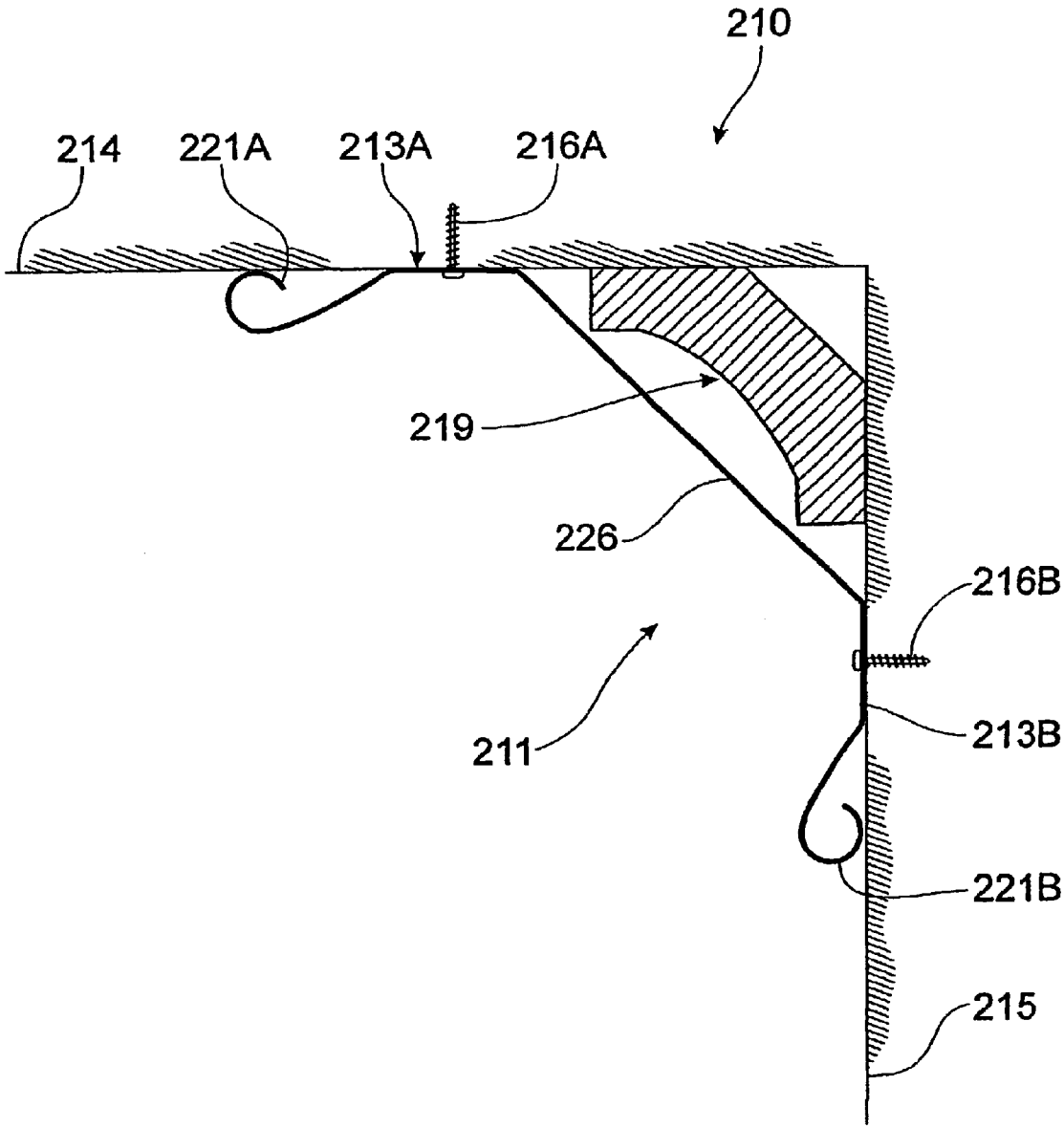
FIG. 3 Side view of yet another embodiment of the bracket mounted over an existing timber moulding.

Referring now to FIG. 3, there is shown another embodiment where bracket 211 comprises first mounting arm 213A terminating in first mating portion 221A and second mounting arm 213B terminating in second mating portion 221B interconnected by intermediate portion 226 oriented at approximately 45° to wall 215 so that in use, intermediate portion 226 extends diagonally across existing timber moulding 219 (or cornice) to thereby allow mounting of removable cornice 212 over timber moulding 219 (or cornice).

Figure 4:
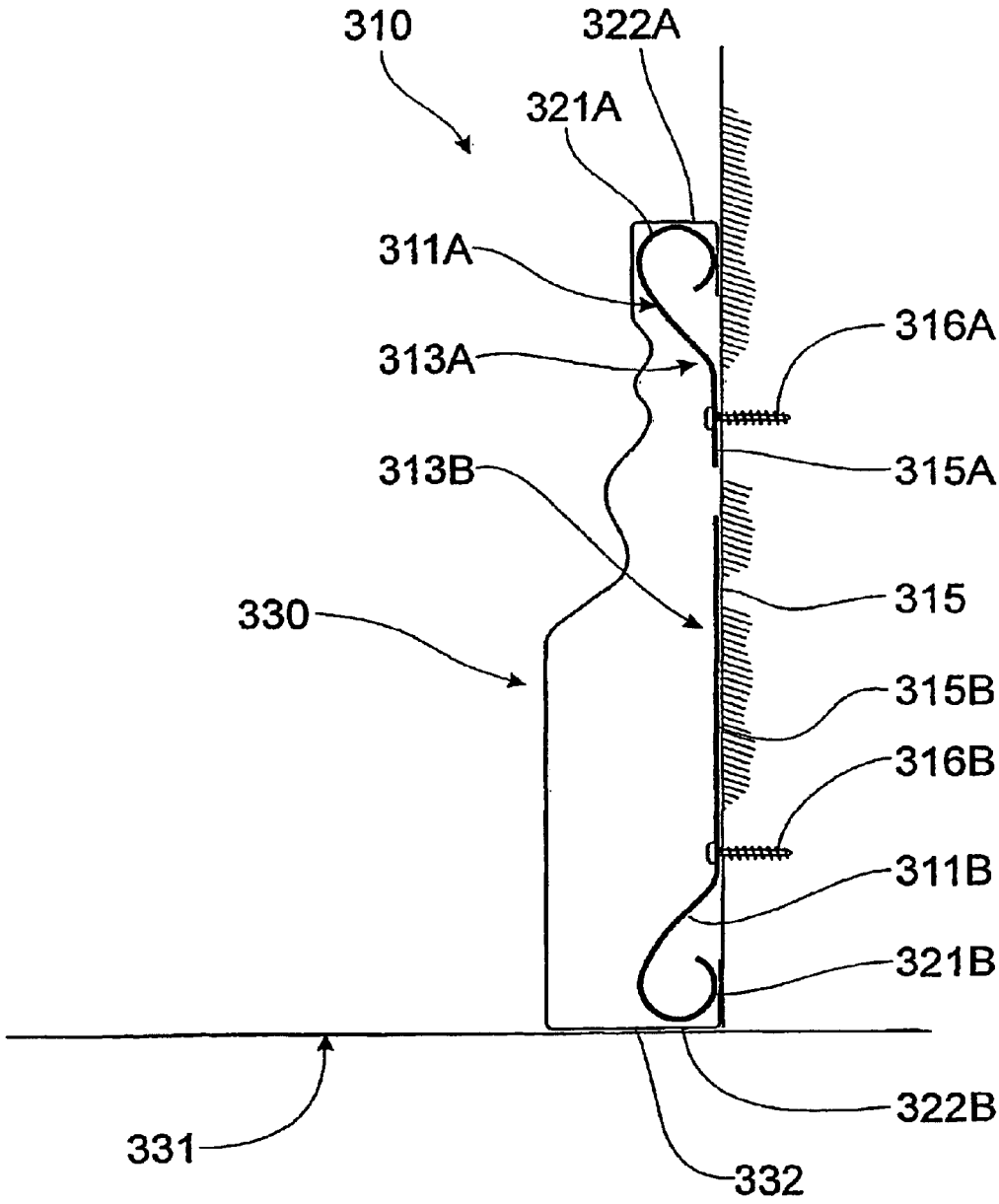
FIG. 4 Side view of a skirting board removably mounted to a wall.
Figure 5:
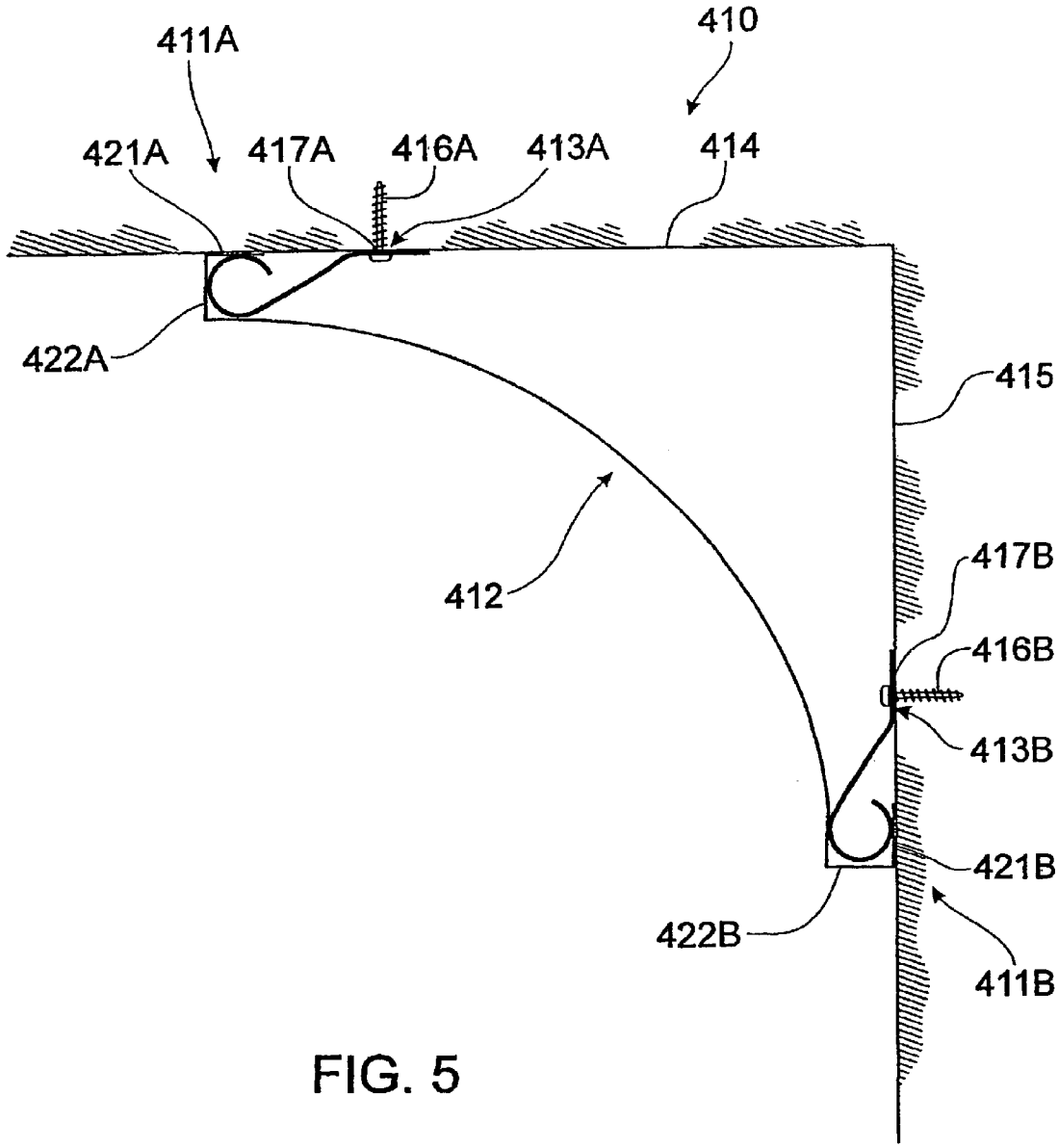
FIG. 5 Side view of a cornice removably mounted to a wall and ceiling without an existing cornice.

In FIGS. 4 and 5, there are described embodiments of the present invention where the ornament is not mounted over an existing ornament.

In FIG. 4 there is shown an embodiment of the present invention wherein ornament assembly 310 comprises an ornament in the form of skirting board 330, first bracket 311A and second bracket 311B. Brackets 311A and 311B respectively have mounting arms 313A and 313B mounted to wall 315 by respective screws 316A, 316B. Bracket 311B is positioned so that base 332 of skirting board 330 is flush with floor 331. Channels 322A and 322B connect with respective open loop ends 321A, 321B of brackets 311A, 311B to thereby removably mount skirting board 330 to wall 315.

In FIG. 5, removably mountable ornament assembly 410 comprises cornice 412, first bracket 411A and second bracket 411B having respective mounting arms 413A and 413B mountable to ceiling 414 and wall 415, respectively. Mounting arm 413A and mounting arm 413B are mounted by way of respective screws 416A, 416B extending through respective apertures 417A, 417B. Mounting arm 413A and mounting arm 413B respectively terminate in open loops 421A and 421B that constitute mating portions of brackets 411A and 411B. Cornice 412 has complementary mating portions in the form of channels 422A and 422B that releasably engage open loop ends 421A and 421B of brackets 411A and 411B respectively.

Figures 6A, 6B:
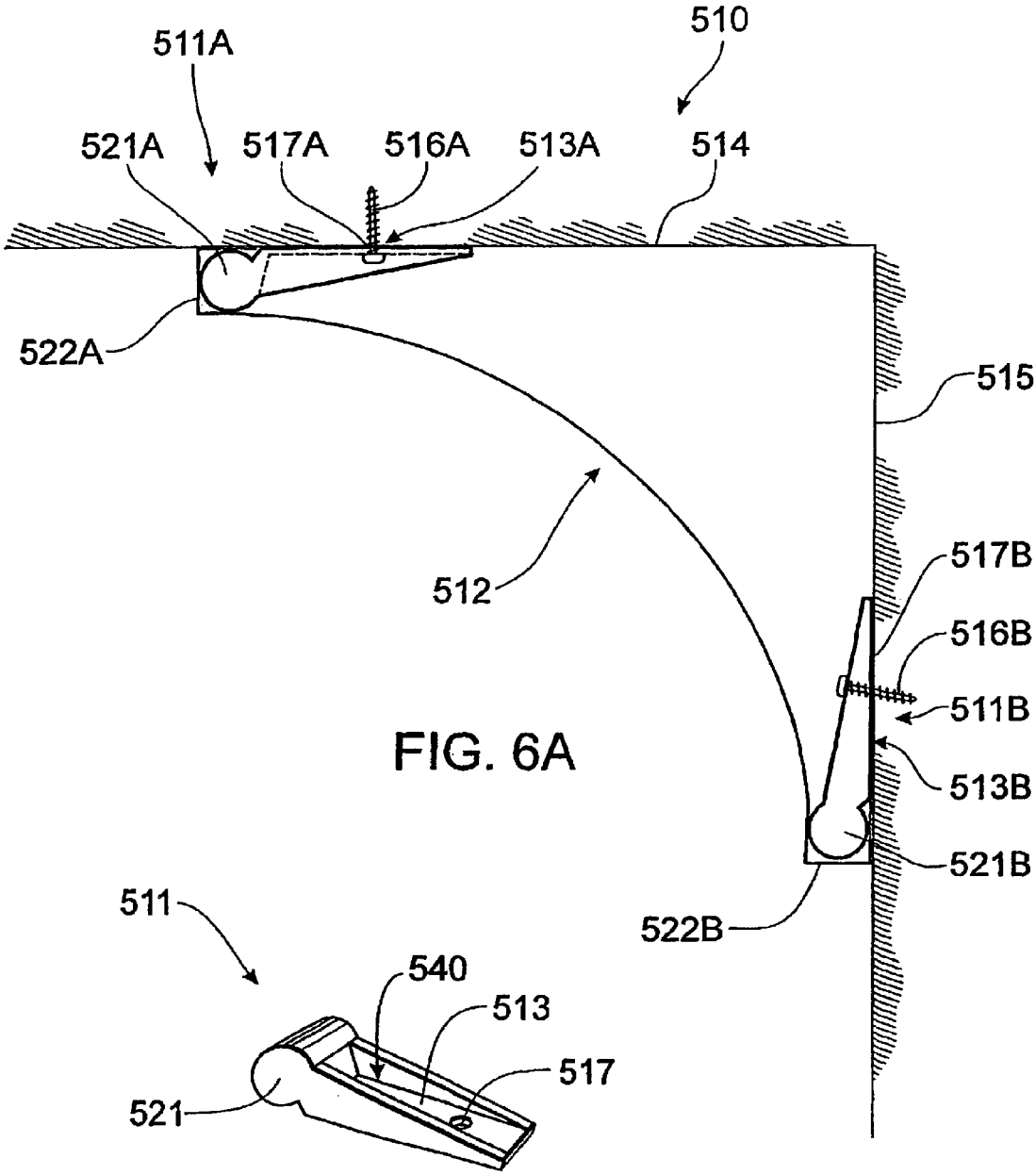
FIG. 6A Side view of a cornice removably mounted to a wall and ceiling by way of a further embodiment of the bracket.
FIG. 6B Perspective view of the bracket embodiment shown in FIG. 6A.
Figure 7:
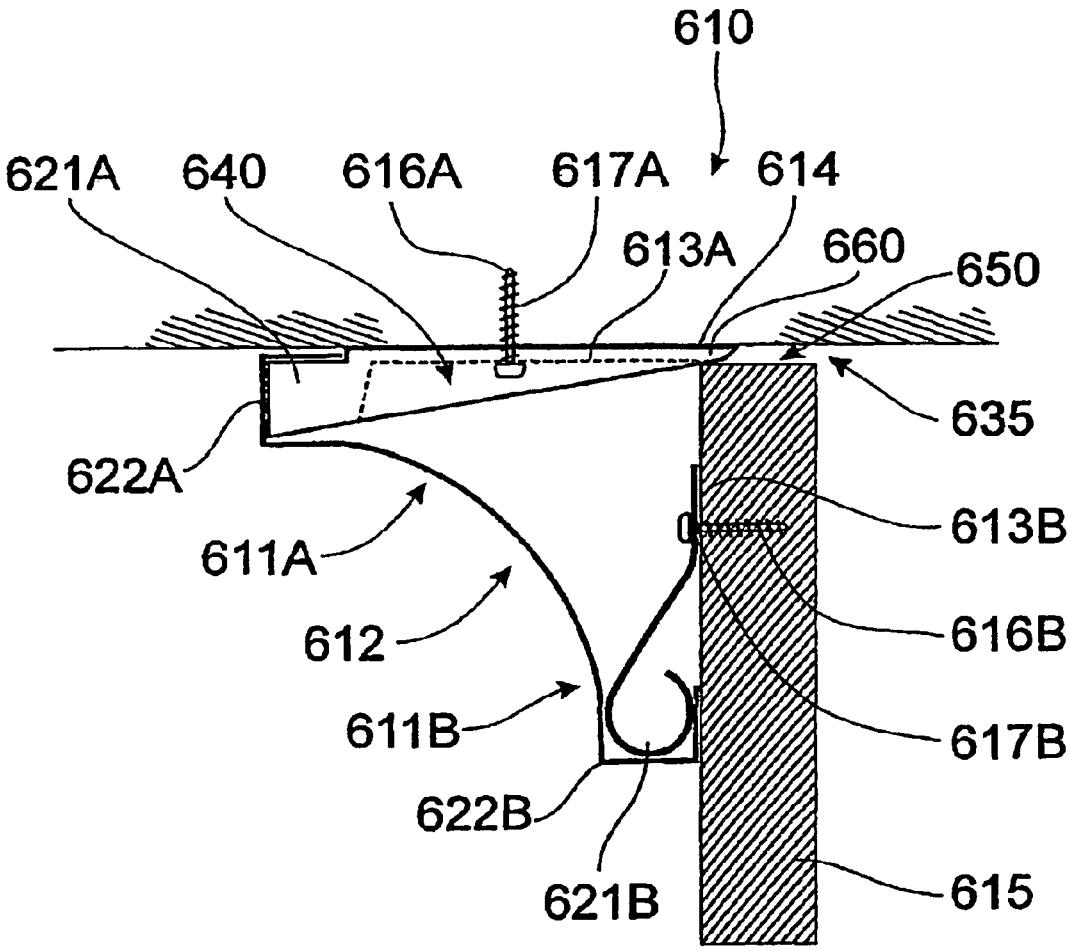
FIG. 7 Side view of a cornice removably mounted to a wall and ceiling by way of a still further embodiment of the bracket.

Referring now to FIGS. 6 and 7, further embodiments of bracket 11 are shown.

In FIG. 6A, brackets 511A and 511B respectively terminate in mating portions in the form of nubs 521A and 521B. These mating portions releasably engage complementary mating portions of cornice 512 in the form of channels 522A and 522B.

In FIG. 6B, it can be seen that bracket 511 has mounting arm 513 with scallop or recess 540 in which is located aperture 517 so that bracket 511 can readily be mounted flush with wall 514 or ceiling 515.

Referring now to FIG. 7, bracket 611A terminates in a mating portion in the form of step 621A that releasably engages complementary mating portion 622A of cornice 612. Mounting arm 613A is tapered so that wedge-end 660 can be inserted, for example, in gap 650 at junction 635 of wall 615 and ceiling 614. Bracket 611A also has scallop or recess 640 in which is located aperture 617A through which screw 616A mounts bracket 611A to ceiling 614. It will also be apparent from FIG. 7 that bracket 611A may be used with another bracket embodiment such as bracket 611B.

Figure 8:
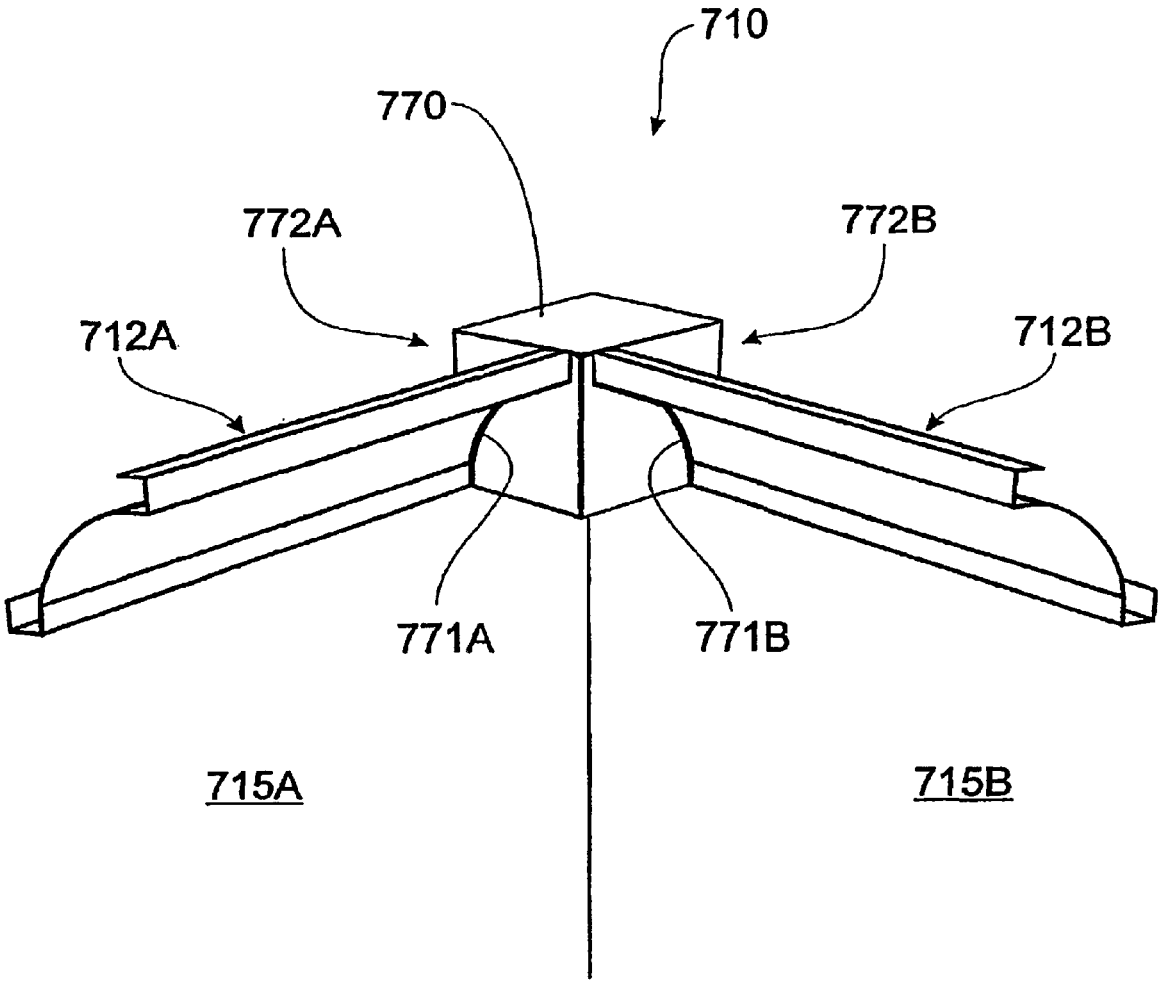
FIG. 8 Perspective view of a removably mounted cornices and mitre block covering cornice ends.

The present invention also contemplates use of mitre blocks that create a neat finish such as at the junctions of cornices 712 as shown in FIG. 8. Although in FIG. 8 mitre block 770 is located in a corner formed by walls 715A, 715B and ceiling (not shown), mitre block 770 could also be used to connect adjoining cornices 712A and 712B along wall 714A, for example, rather than in the corner between adjacent walls 715A, 715B. Mitre block 770 has mitres 771A and 771B that receive and accommodate ends 772A and 772B of respective corner-joined cornices 712A and 712B. Mitres 771A and 771B may be readily created to accommodate a particular cross-sectional profile of cornices 712A and 712B. Another feature of mitre block 770 would be cut-out portions (not shown) that allow the corner block to be fitted over an existing cornice. Mitre block 770 may also have surface patterns, etchings, sculpturing or other ornamentation (not shown) that adds to the visual attractiveness of the mounted cornices. As an alternative to mitre blocks, cornice junctions may be finished by normal 45° corner mitring. Also contemplated are other decorative devices such as ornamental strips attachable at joins formed by ends of adjacent cornices 712A and 712B. Also contemplated by the present invention are use of blocks, ornamental strips, arches, covings and other finishes such as described in Australian Patent 548675 and Australian Patent 560796 which are each incorporated herein by reference.

Figure 9:
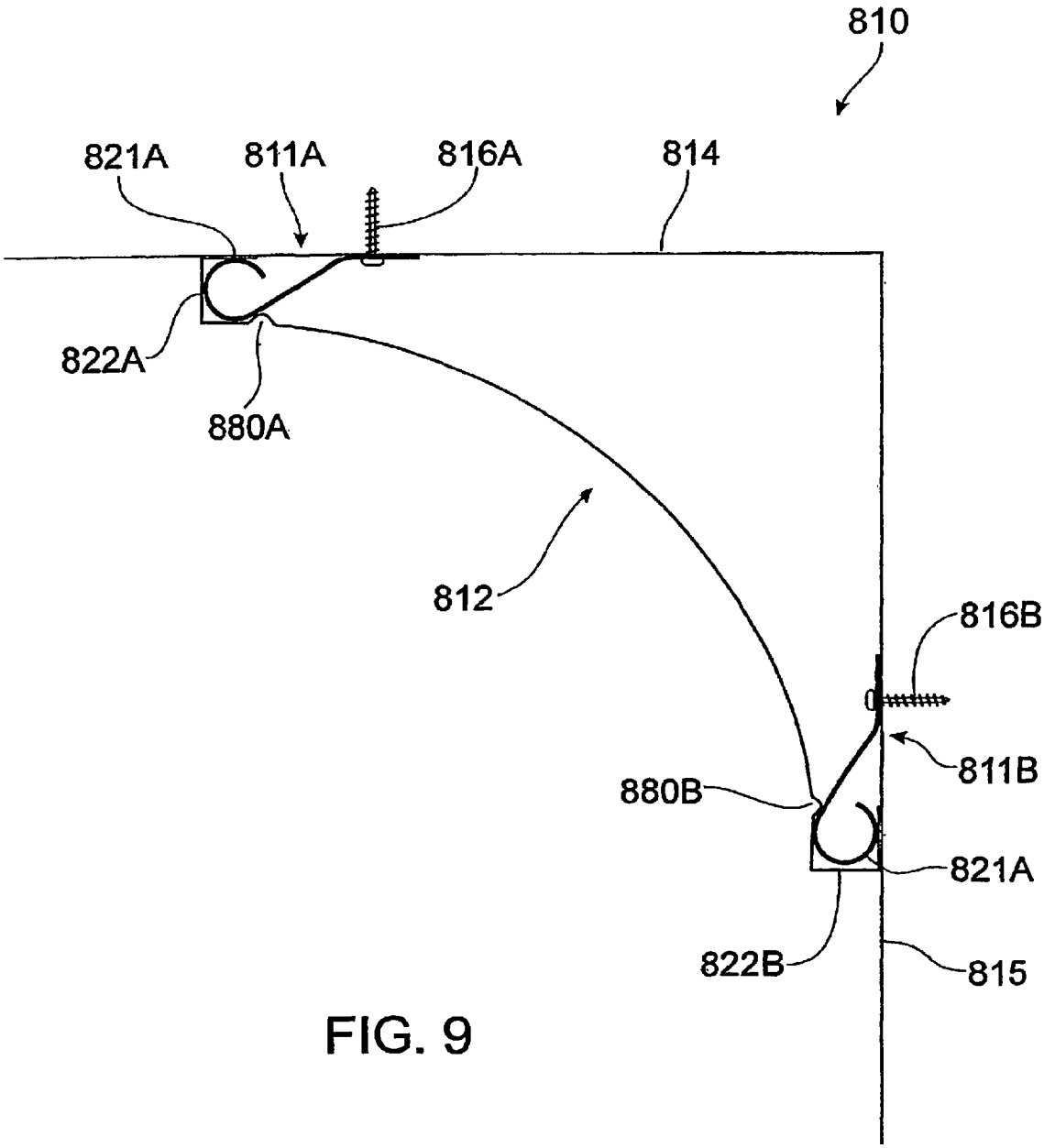
FIG. 9 Perspective view of a removably mounted cornice having a plurality of ribs that facilitate engagement with a bracket.

Referring now to FIG. 9, an embodiment of cornice 812 is shown which may be particularly useful when cornice 812 is formed of a relatively flexible material such as extruded plastic. In this embodiment, channels 822A and 822B of cornice 812 have respective ridges 880A and 880B that extend at least partly along the length thereof, so that in use, a portion of each of ridges 880A and 880B bears against open respective loops 821A and 821B of bracket 811A and 811B to facilitate firm engagement between brackets 811A and 811B and cornice 812. The location of ridges 880A and 880B may also vary compared to that shown in FIG. 9 while still sufficiently contacting bracket 811. It will also be appreciated that channel 822A and/or 822B may have respective ridges 880A and/or 880B, without there necessarily being a ridge 880 in each channel 822. Furthermore, it is not essential that ridges 880A and 880B extend along the entire length of channels 822A and/or 822B, for example there may be a plurality of shorter channels 880, in order to sufficiently contact bracket 811.

The present invention provides a wall or ceiling ornament and mounting bracket therefor that can be readily installed by persons without the need for tradesman-like skills. The cornice of the invention therefore provides a useful alternative to traditional plaster cornices, the latter requiring considerable skill for installation. Ready installation is particularly enhanced given that existing cornices need not be removed, which also has the advantage that the "original" ornamental features of a home need not be destroyed during renovation. Furthermore, no adhesive, contact cement or plaster is required, so that the cornice of the invention can be removably mounted with ease. The visual appeal of the mounted cornice assembly is also superior to the prior art as the mounted cornice effectively obscures the brackets from view.

The ornament of the invention can therefore be removably installed as an original ornament, or to cover and replace an existing ornament.

It will also be appreciated that the mounting brackets of the invention can be readily adapted in terms of shape and dimension according to the ornament to be mounted and, where necessary, the existing ornament to be covered.

It will be appreciated by the skilled person that the present invention is not limited to the embodiments described in detail herein, and that a variety of other embodiments may be contemplated which are nevertheless consistent with the broad spirit and scope of the invention.

What is claimed is:

1. A cornice assembly removably mountable to one or more building panels having an existing cornice, said assembly comprising a cornice and one or more brackets, wherein said brackets each comprise at least one mounting arm having at least one mating portion at a distal end thereof which is adapted to releasably engage a complementary mating portion of said cornice, said mounting arm positionable relative to the existing cornice mounted to said one or more building panels so that said mating portion of said bracket can releasably engage said complementary mating portion of said cornice and thereby facilitate mounting of said cornice over at least part of said existing cornice.

2. The cornice assembly of claim 1, wherein said mating portion of said bracket is an open loop engageable with a complementary channel of said cornice.

3. The cornice assembly of claim 1, wherein said mating portion of said bracket is a nub engageable with a complementary channel of said cornice.

4. The cornice assembly of claim 1, wherein said mating portion of said bracket is a step engageable with a complementary channel of said ornament.

5. The cornice assembly of claim 1, wherein said cornice comprises complementary mating portions in the form of two parallel channels.

6. The cornice assembly of claim 5, wherein the cornice further comprising a ridge extending at least partly along one of said channels whereby in use, a portion of said ridge bears against said mating portion of said bracket to facilitate engagement between said bracket and said cornice.

7. The cornice assembly of claim 6, wherein said bracket comprises a first mounting arm and a second mounting arm interconnected by an intermediate portion which in use extends diagonally across an existing ornament mounted at a junction between first and second said building panels.

8. At least one building panel comprising the cornice assembly of claim 1 removably mounted thereto.

9. A method of removably mounting a cornice to at least one building panel covering an existing cornice mounted to the or each said building panel, said method including the steps of:

(i) removably mounting one or more brackets to the or each said building panel, said one or more mounting brackets being positioned relative to said existing cornice so that said one or more brackets allow mounting of said cornice covering said existing cornice;

(ii) releasably engaging complementary mating portions of said cornice with respective mating portions of said one or more brackets to thereby removably mount said cornice to the or each said building panel; and (ii) covering said existing cornice with said cornice.

* * * * *